US008127419B2

(12) United States Patent
Calton et al.

(10) Patent No.: US 8,127,419 B2
(45) Date of Patent: Mar. 6, 2012

(54) SYSTEM AND METHOD FOR RETASKING SALVAGED GUARDRAIL MATERIALS

(76) Inventors: Thomas Cecil Calton, Rutherfordton, NC (US); Terry Francis Jordan, Rutherfordton, NC (US)

( * ) Notice: Subject to any disclaimer, the term of this patent is extended or adjusted under 35 U.S.C. 154(b) by 373 days.

(21) Appl. No.: 12/381,359

(22) Filed: Mar. 11, 2009

(65) Prior Publication Data

US 2010/0230652 A1 Sep. 16, 2010

(51) Int. Cl.
*B23P 6/00* (2006.01)

(52) U.S. Cl. ..... 29/402.09; 29/402.13; 29/402.16; 29/402.18; 29/401.1; 29/403.1; 29/458; 29/402.14; 29/402.15

(58) Field of Classification Search ..... 29/401.1, 29/402.09, 402.14, 402.15, 402.16, 402.17, 29/402.18, 403.1, 458
See application file for complete search history.

(56) References Cited

U.S. PATENT DOCUMENTS

| | | | | |
|---|---|---|---|---|
| 3,848,854 | A | 11/1974 | De Barbieri | |
| 4,311,199 | A | 1/1982 | Elias | |
| 4,682,762 | A * | 7/1987 | Lekavich | 256/65.11 |
| 4,858,876 | A | 8/1989 | Moreno | |
| 5,100,107 | A | 3/1992 | Latta | |
| 5,274,971 | A | 1/1994 | Elmore et al. | |
| 5,392,572 | A | 2/1995 | Elmore et al. | |
| 5,572,847 | A | 11/1996 | Elmore et al. | |
| 5,913,508 | A | 6/1999 | Eades | |
| 6,398,192 | B1 * | 6/2002 | Albritton | 256/13.1 |
| 6,540,209 | B2 | 4/2003 | Ross | |
| 6,637,971 | B1 | 10/2003 | Carney et al. | |
| 6,840,507 | B2 | 1/2005 | Brown | |
| 7,044,449 | B2 | 5/2006 | Wink | |
| 7,216,853 | B2 | 5/2007 | Wall | |
| 7,384,024 | B2 | 6/2008 | Wink | |
| 7,419,141 | B2 | 9/2008 | Wall | |
| 7,458,140 | B2 * | 12/2008 | Harris | 29/401.1 |
| 2003/0106274 | A1 * | 6/2003 | Sievers | 52/292 |
| 2007/0023588 | A1 | 2/2007 | Symons | |
| 2008/0157046 | A1 | 7/2008 | Murphy | |
| 2011/0067341 | A1 * | 3/2011 | Smith | 52/582.1 |

FOREIGN PATENT DOCUMENTS

KR 2003079850 A * 10/2003

* cited by examiner

*Primary Examiner* — Essama Omgba
(74) *Attorney, Agent, or Firm* — John R. Perkins, Jr.

(57) ABSTRACT

An environmentally responsible system and method of reusing discarded guardrail materials to provide affordable, high-strength barriers and fencing. Discarded guardrails, guardrail posts, and guardrail blockouts are resized and reconfigured to provide barriers for use in alternative applications, such as agrifencing, where the high-strength, durability, and low cost of these formerly DOT-approved guardrail materials provide superior performance to wood and thin metal barriers. The invention also greatly increases the return on investment of state DOTs by providing an aftermarket for used guardrail materials, thereby allowing state DOTs to recover much of the initial costs, which can then be used to offset future costs in order facilitate more highway improvement projects.

9 Claims, 5 Drawing Sheets

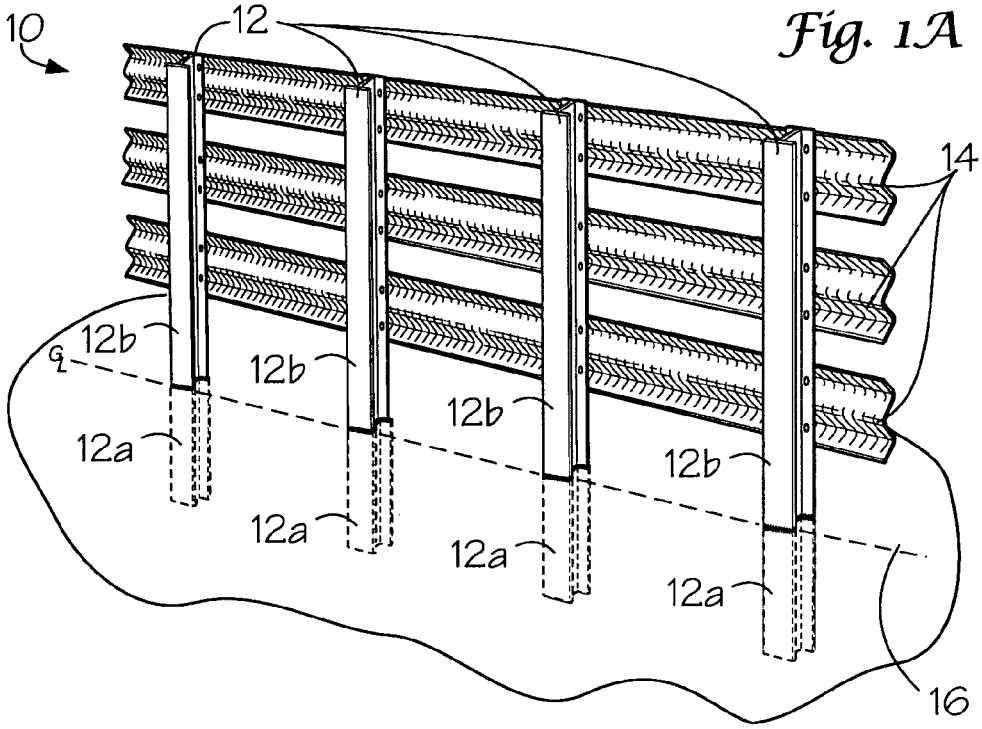
Fig. 1A
Fig. 1B
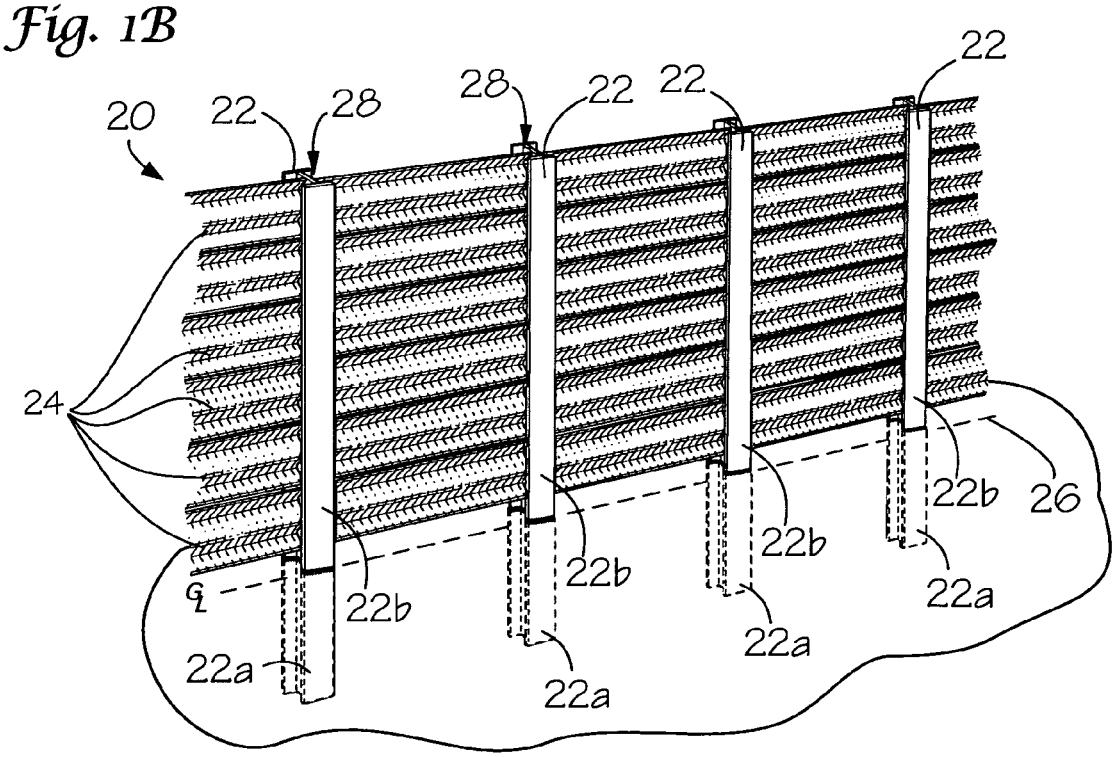

60
62a
64
62b
66a
67
66b
68a
68b
69b
69a 68a
69a 70
72c
72d 72b
72a

SYSTEM AND METHOD FOR RETASKING SALVAGED GUARDRAIL MATERIALS

FIELD OF THE INVENTION

The present invention generally relates to a barrier system and, more particularly, to a high-strength, durable and weather resistant barrier and fencing system constructed of salvaged guardrail materials. These salvaged materials were originally manufactured according to the rigorous standards set by the American Association of State Highway and Transportation Officials (AASHTO) in order to obtain Department of Transportation (DOT) approval for highway guardrail use. For that reason, salvaged guardrail materials retain the majority of their original strength, durability and weather resistance, making them a low-cost but generally superior alternative to current barrier and fencing systems.

BACKGROUND OF THE INVENTION

State DOTs are required to use approved materials for highway guardrail systems. These materials are very expensive when new because they must be originally manufactured for DOT approval according to the high standards for highway barriers set by AASHTO. That organization is tasked with setting the standards for quality, strength, durability, and weather resistance of highway guardrail materials to make them incredibly strong with a nearly infinite lifespan once installed. The stated mission of AASHTO is to advocate transportation-related policies and provide technical services to support states in their efforts to efficiently and safely move people and goods.

As part of that ongoing effort, AASHTO promulgates standards for highway guardrail systems in its AASHTO-AGC-ARTBA Joint Committee Subcommittee on New Highway Materials Task Force 13 Report, entitled "A Guide to Standardized Highway Barrier Hardware." The Guide specifies the standards for each component that may be used in an approved guardrail system, which standards generally consist of detailed drawings of acceptable materials, along with detailed Specifications and the Intended Use for each.

For example, the most common type of guardrail post currently in use is known as a wide-flange guardrail post. AASHTO sets forth the standards for this post in document PWE-01-04. The wide-flange guardrail post PWE-01 is mandated 72 inches in length, as are most guardrail posts, although it is not uncommon to encounter variations in length from 69 inches to 78 inches and more. More specifically, AASHTO mandates that the PWE-01 post must be what is known as a W6×9 metal guardrail post, whereby the designation "W" stands for wide flange in these I-beam metal posts, "6" stands for the depth of the I-Beam (often thought of as the width of the I-beam), and "9" stands for metal that weighs 9 pounds per foot. The Specifications set forth in document PWE-01-04 state that AASHTMO M 270/M 270M (ASTM A 709/A 709M) Grade 25[250] steel must be used unless corrosion-resistant steel is required, in which case the post must be manufactured from AASHTMO M 270/M 270M (ASTM A 709/A 709M) Grade 50W [345W] steel. The specifications go on to state that the PWE-01 post must be zinc-coated for weather-resistance according to AASHTO M 111 (ASTM A 123), another AASHTO standard.

The same is true of other guardrail system components, including guardrails themselves, which are all equally bound by AASHTO standards. W-beam metal guardrails, for example, must have a specific shape whereby the surface of the guardrails resemble the letter W. The metal specified in the guardrail Specifications is generally the same AASHTO M 270/M 270M grade steel set forth above.

Often a blockout is included as a spacer between the guardrail post and the guardrail. These blockouts must also be constructed of materials meeting AASHTO standards and typically are made of the same incredibly strong AASHTO M 270/M 270M grade steel, but are occasionally made of timber as set forth in AASHTO documents PWB01 and PDB01a-b. To prevent rust and ensure a long lifespan, when these post, blockout, and guardrail materials are metal they must be weather coated according to AASHTO M 111 standards, which means Type II galvanized or Type IV corrosion-resistant.

According to AASHTO document PDB01a-b, if the posts or blockouts are made of timber, however, weather resistance is generally specified as preservation treatment in accordance with AASHTO M 133 after all end cuts are made and holes are drilled. The type of timber is also very important and AASHTO documents PDE01-08 and PDB01a-b, for example, require the use of timber with a stress grade of at least 1160 pounds per square inch (psi) for all timber guardrail posts and blockouts.

All of these materials have in common the characteristics of strength, durability, and long lifespan once manufactured and installed according to AASHTO standards. Once installed, however, all of these materials have the same deficiency in common—they cannot be removed and reused along most highways because removal voids the DOT approval by violating AASHTO and federal highway standards. So when undamaged and perfectly useable materials are removed for projects, such as widening a roadway, those materials are discarded. This is especially true when federal funding is involved because federal oversight prohibits reuse. The outcome provides little potential for a state DOT to recoup any of its initial costs in purchasing the materials and, more importantly, often results in landfill disposal of otherwise useful materials.

The general practice, therefore, is to pay scrap companies to remove used guardrail materials for transport and landfill disposal with other refuse. Higher than normal disposal rates must also be paid because the materials are galvanized for weather resistance and the zinc involved is a mild toxin.

Occasionally, however, if enough material is involved at any given time, state DOTs have been able to recoup a small portion of the original cost by selling these materials to scrap companies for recycling. The amount of money recouped in this manner is generally little more than the cost of having the material removed.

In any event, both of these practices are very wasteful because numerous applications other than highway barriers would benefit from the same quality, strength, durability, and weather resistance found in these guardrail materials. But other applications would not require DOT approval of the materials so employing discarded guardrail materials would not present a problem as long as the guardrails and posts can be reconfigured and resized for such applications.

Farmers, for example, generally build feed lots and loading pens from wood, which is a much weaker material with a lifespan of less than 10 years. Other lots and pens are built from iron or steel, which is somewhat stronger but easily dented because only thin gauge metal is affordable. Thus even if a farmer is able to afford the cost of building a metal feed lot or loading pen, galvanized metal is cost prohibitive so the metal must be repainted often or replaced after approximately 20 years due to corrosion.

It is possible, however, that discarded guardrail materials may be retasked as a building material for many alternate applications such as the above. But many difficulties exist that have heretofore prevented retasking of discarded guardrail materials. The most common problem is that guardrails generally use only six-foot posts that are installed so that the guardrail is set approximately two feet above the ground when used in DOT-approved highway barrier applications. More specifically, a typical highway barrier requires an approximately six-foot post to be installed approximately four feet into the ground to withstand the extreme force involved when contacted by a motor vehicle weighing tons and potentially moving at high speeds. In most cases only a single length of guardrail is needed so only approximately two feet of the post remains above the ground to carry the single guardrail at the proper height to withstand such impacts.

By contrast, a feed lot or loading pen would need to be at least six feet high to prevent the passage of livestock. And although the feed lot or loading pen needs to be much stronger than current wood and metal barriers, the posts would not need to be installed four feet into the ground to withstand the force of crowded livestock, which is drastically lower than the force involved in an automobile collision. As such, a post of approximately seven to eight feet would generally be sufficient so that approximately two feet is buried into the ground and five to six feet remains above ground. In addition, this five to six foot height of guardrail would need to carry multiple lengths of guardrail to effectively block the passage of livestock. Unfortunately, these differences prevent the use of previously DOT-approved guardrail posts because such posts are mostly manufactured in approximately six-foot lengths and because more than a single length of guardrail is needed to provide an effective barrier to livestock.

An affordable barrier system with the strength, durability, and weather resistance of guardrail materials would be useful as long as it could be reconfigured, manufactured and installed for a reasonable price. Yet no prior art systems have met this need with either new or used guardrail materials.

In view of the above, it would be desirable to provide a system and method of installing an affordable barrier system reconfigured from discarded guardrail into a useful size and configuration in alternative applications not requiring DOT approval.

An object of the invention is to provide a system and method of reusing formerly DOT-approved guardrail materials to provide strong, durable, and affordable barrier systems.

A further object of the invention is to provide a system and method of reusing these materials so that state DOTs can recoup more of the initial costs when the material is removed, thereby providing greater funding for current and future roadway projects.

A further object of the invention is to provide a system and method of reusing these materials to avoid landfill disposal, which is wasteful, costly to state DOTs, and harmful to the environment.

SUMMARY OF THE INVENTION

The present invention accomplishes the foregoing objects by providing a system and method of reconfiguring and installing an affordable barrier system with the strength, durability, and weather resistance of guardrail materials, in alternative applications not requiring DOT approval. More specifically, the present invention provides a barrier system comprising used guardrails, preferably W-beam guardrails, attached to the surface of resized guardrail posts, preferably constructed from two or more guardrail posts or blockouts connected end-to-end and cut to an appropriate length for specific applications. A preferred embodiment of the invention involves a method of retasking, by reconfiguring and resizing, discarded guardrail materials wherein standard 6-foot W6×9 guardrail posts are resized into 8-foot lengths by cannibalizing other W6×9 posts and blockouts. In this way, otherwise disposable used guardrail materials are reconfigured and installed in alternative applications such as agrifencing.

In one aspect of the invention a method of adapting salvaged highway guardrail materials to provide multifunctional, weather resistant, reinforced barrier systems in an environmentally responsible manner is provided comprising the steps of: providing a plurality of salvaged highway guardrail materials comprising W6×9 guardrail posts having a length of approximately six feet and W-beam guardrails of various lengths, wherein the plurality of salvaged highway guardrail materials was originally manufactured using AASHTO M 270/M 270M grade steel; selecting a first and second W6×9 guardrail post from the plurality of salvaged highway guardrail materials; cutting the second W6×9 guardrail post to provide a shortened W6×9 guardrail post of approximately two feet; welding a distal end of the first W6×9 guardrail post to a distal end of the shortened W6×9 guardrail post to permanently join the first W6×9 guardrail post and the shortened W6×9 guardrail post, thereby providing a first resized W6×9 post having a continuous length of approximately eight feet; applying a weather-resistant coating to the welded junction of the first resized W6×9 post to prevent degradation from weather and ground exposure; inserting a distal end of the first resized W6×9 post into a ground surface approximately two feet for stabilization in a vertical orientation, whereby approximately six feet of the first resized W6×9 post protrudes from the ground surface in a vertical arrangement to provide a first vertical support beam; providing a second resized W6×9 post in the manner defined for providing the first resized W6×9 post; applying a weather-resistant coating to the welded junction of the second resized W6×9 post to prevent degradation from weather and ground exposure; inserting a distal end of the second resized W6×9 post into a ground surface approximately two feet for stabilization in a vertical orientation and spaced at least one foot horizontally from the first resized W6×9 post, whereby approximately six feet of the second resized W6×9 post protrudes from the ground surface in a vertical arrangement to provide a second vertical support beam; and mounting a first end of at least one W-beam guardrail to the first resized W6×9 post and a second end to the second resized W6×9 post in a fixed and generally horizontal arrangement to define a barrier to passage between the first resized W6×9 post and the second resized W6×9 post.

In another aspect of the invention, the foregoing method further comprises the step of mounting the first end of at least one W-beam guardrail within a recess defined along one side of the first resized W6×9 post and the second end of at least one W-beam guardrail within a recess defined along an opposing side of the second resized W6×9 post.

In another aspect of the invention, a method of converting salvaged guardrail materials into multifunctional, weather resistant, reinforced barrier systems is provided comprising the steps of: providing a plurality of salvaged highway guardrail materials comprising W6×9 guardrail posts having a length of approximately six feet, W6×9 guardrail blockouts having a length of approximately 14 inches to 22 inches, and W-beam guardrails of various lengths, wherein the plurality of salvaged highway guardrail materials was originally manufactured according to AASHTO standards; selecting a first and second length of guardrail post material from the plurality of salvaged highway guardrail materials; joining a distal end of the first length of guardrail post material to a distal end of the second length of guardrail post material to provide a first resized post; inserting a distal end of the first resized post into a ground surface for stabilization in a vertical arrangement to provide a first vertical support beam; providing a second resized post in the manner defined for providing the first resized post; inserting a distal end of the second resized post into a ground surface for stabilization in a vertical arrangement to provide a second vertical support beam; and mounting a first end of at least one W-beam guardrail to the first resized post and a second end to the second resized post to define a barrier to passage between the first resized post and the second resized post.

In a further aspect of the invention, the foregoing method further comprises the step of mounting first end of at least one W-beam guardrail within a recess defined along one side of the first resized W6×9 post and the second end of at least one W-beam guardrail within a recess defined along an opposing side of the second resized W6×9 post.

In yet another aspect of the invention, the foregoing method further comprises the steps of applying a weather-resistant coating to the junction on the first resized post and applying a weather-resistant coating to the junction on the second resized post.

In another aspect of the invention, the foregoing method further comprises the step of providing the plurality of salvaged highway guardrail materials further comprising timber guardrail posts and timber guardrail blockouts, each with a stress grade of at least 1160 psi.

In a further aspect of the invention, the foregoing method further comprises the step of selecting the first and second lengths of guardrail post material from the plurality of salvaged highway guardrail materials, wherein each of the first and second lengths of guardrail post material was originally weather-coated according one of AASHTO M 111 and AASHTO M 133 standards.

In another aspect of the invention, the foregoing method further comprises the step of selecting the first and second lengths of guardrail post material from the plurality of salvaged highway guardrail materials, wherein each of the first and second lengths of guardrail post material was originally weather-coated as either Type II galvanized or Type IV corrosion-resistant.

According to another aspect of the invention, an environmentally responsible, multifunctional, weather-resistant, reinforced barrier system is adapted from salvaged highway guardrail materials comprising: a first resized guardrail post constructed from a first and second guardrail post, each of the first and second guardrail posts being selected from a plurality of salvaged highway guardrail materials originally manufactured according to AASHTO standards, the plurality of salvaged highway guardrail materials including W6×9 guardrail posts having a length of approximately six feet, W6×9 guardrail blockouts having a length of approximately 14 inches to 22 inches, and W-beam guardrails of various lengths, wherein the second guardrail post is shortened to a desired length and permanently joined at distal ends with the first guardrail post to provide the first resized post, a distal end of the first resized post being inserted into a ground surface for stabilization in a vertical orientation and the remaining portion of the first resized post protruding from the ground surface in a vertical arrangement to provide a first vertical support beam; a second resized post provided in the same manner as the first resized post and inserted into the ground surface in the same manner as the first resized post; the first resized post and the second resized post each including a weather-resistant coating to prevent degradation from weather and ground exposure; and at least one W-beam guardrail mounted to the first resized post and the second resized post in a fixed and generally horizontal arrangement to define a barrier to passage between the first resized post and the second resized W6×9 post.

In another aspect of the invention, the plurality of salvaged highway guardrail materials from the foregoing system further includes timber guardrail posts and timber guardrail blockouts, each having a stress rating of at least 1160 psi.

In still another aspect of the invention, the first and second guardrail posts of the foregoing system are originally manufactured using either AASHTO M 270/M 270M grade 36 [250] steel and AASHTO M 270/M 270M grade 50W [345W] steel or timber with a stress rating of at least 1160 psi.

The accompanying drawings, which are incorporated into and constitute a part of this specification, illustrate one or more embodiments of the invention and, together with the description, serve to explain the invention further.

DESCRIPTION OF THE DRAWINGS

The invention will be more readily understood with reference to the following specification in conjunction with the drawings here.

FIG. 1*a* illustrates an agricultural barrier system for restricting the passage of livestock according to one aspect of the invention.

FIG. 1*b* illustrates a wind break for use in the protection of livestock according to another aspect of the invention.

DESCRIPTION OF THE PREFERRED EMBODIMENTS

Figures 2A, 2B, 2C, 2D, 2E:
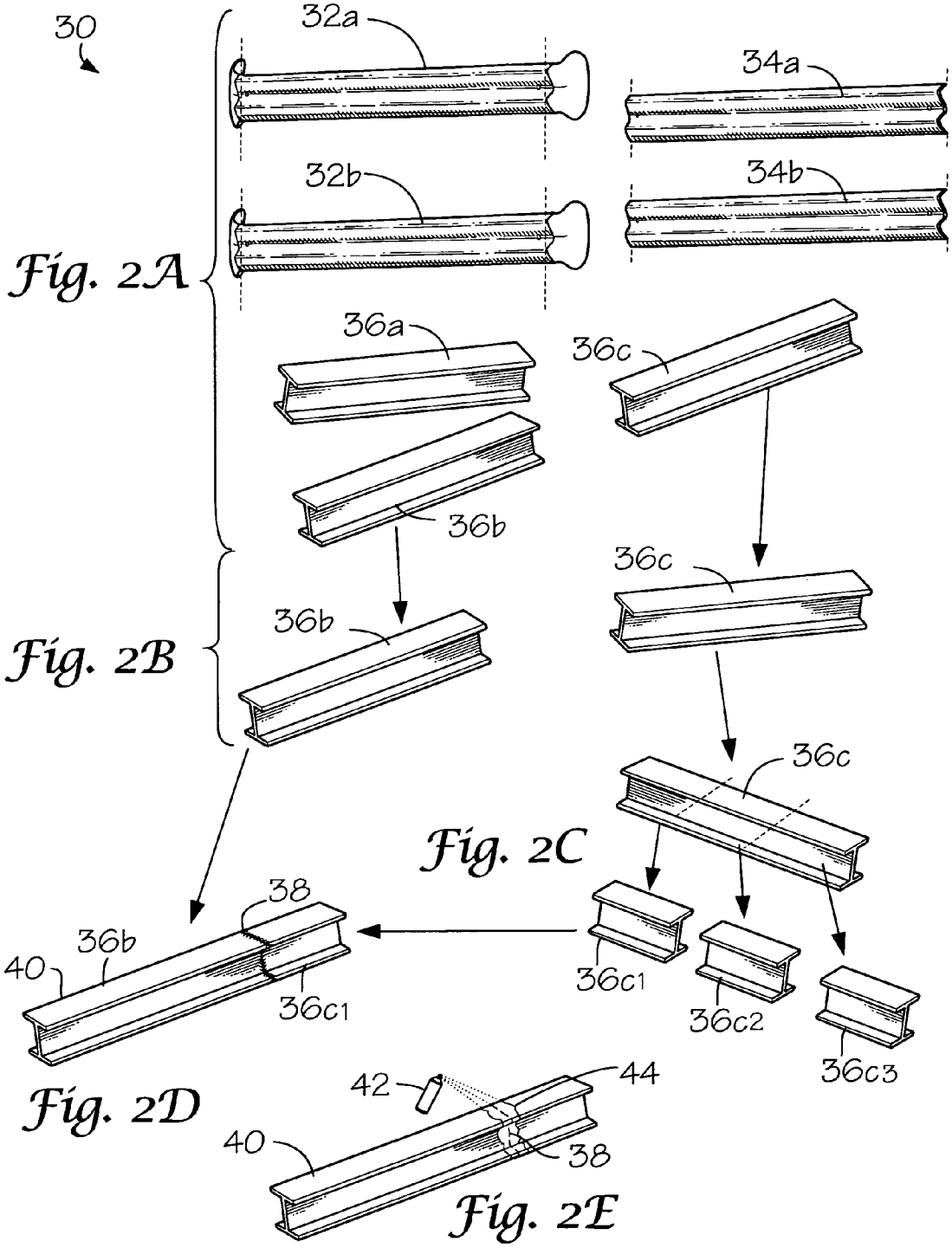
FIG. 2*a* illustrates a plurality of salvaged highway guardrail materials including W-beam guardrails and six-foot W6×9 guardrail posts.
FIG. 2*b* illustrates selecting a first and second W6×9 guardrail post from the plurality of salvaged highway guardrail materials.
FIG. 2*c* illustrates cutting the second W6×9 guardrail post into three approximately equal two-foot lengths.
FIG. 2*d* illustrates a resized W6×9 guardrail post provided by welding a first six foot W6×9 guardrail post to a two-foot portion of a second W6×9 guardrail post.
FIG. 2*e* illustrates applying a weather-resistant coating to the welded junction on a resized guardrail post.

The invention provides an affordable, high-strength, and durable barrier system useful in many applications, such as agrifencing, otherwise known as agricultural fencing. Referring now to FIG. 1*a*, an agricultural barrier system is illustrated for preventing the passage of livestock according to one embodiment of the invention. Barrier system 10 is an environmentally responsible, multi-functional, weather-resistant, reinforced barrier system adapted from salvaged highway guardrail materials. Barrier 10 comprises a plurality of resized guardrail posts 12, inserted into a ground surface 16 approximately two feet so as to provide a plurality of vertical support beams. Each of the resized fence posts 12 is comprised of two sections welded together to form a lengthened resized guardrail post. Section 12*b* generally begins as a standard six-foot W6×9 salvaged guardrail post that is readily available when salvaging guardrails materials. The standard six-foot W6×9 post is cut into three approximately equal two-foot lengths, such as 12*a* of FIG. 1*a*. Section 12*a* is, therefore, also constructed of the same W6×9 guardrail material as 12*b*. Moreover, at least two common ways of creating section 12*a* exist. A first way is as previously described to take a standard W6×9 guardrail post, such as 12*b*, and cut it into three equal approximately two-foot portions. A second way is to simply use a standard W6×9 guardrail blockout, which generally comes in 14 inch to 22 inch lengths. Once selected and properly sized, sections 12*a* are welded to sections 12*b* to form each of the plurality of resized guardrail posts 12.

In this embodiment, three equal lengths of W-beam guardrail 14 are attached to a front surface of each of the resized guardrail posts 12. In this way, a barrier to passage is created for common applications such as agricultural feed lots and loading pens.

Referring now to FIG. 1*b*, a plurality of resized guardrail posts 22 is illustrated to provide a plurality of vertical support beams. Similar to FIG. 1*a*, each of the resized guardrail posts 22 in this embodiment is comprised of a standard six-foot W6×9 guardrail post 22*b* welded to a two-foot section of W6×9 guardrail post material 22*a*. Approximately two feet of the length of each resized post 22 is inserted into ground surface 26 to provide the plurality of vertical support beams as shown. In this embodiment, W-beam guardrails are placed within the recess 28 on each side of each of the plurality of resized guardrail posts 22. The I-beam shape and configuration of each W6×9 resized post is ideal to provide an approximately one inch recesses 28 on each side of the resized posts 22. In this way, a horizontal length of W-beam guardrail 24 is easily mounted between each of the resized guardrail posts 22 and stacked as shown in FIG. 1*b*. The resulting barrier system provides an excellent wind break for livestock during winter months and during storms because the materials used are weather-resistant, multi-functional and reinforced so as to provide an environmentally responsible solution.

Referring now to FIG. 2*a*, a plurality of salvaged guardrail materials 30 is illustrated including W-beam guardrails 32*a*, 32*b*, 34*a* and 34*b* and W6×9 guardrail posts 36*a*, 36*b* and 36*c*. Each of these salvaged guardrail materials was originally manufactured according to AASHTO standards, which is to say in the case of metal guardrail posts, each of the posts 36*a*, 36*b* and 36*c* was originally manufactured using W6×9 posts made of AASHTO M 270/270M grade steel. Each of the guardrail posts 36*a*, 36*b* and 36*c* are further weather-proofed according to AASHTO M 111 standards so that each is either Type II galvanized or Type IV corrosion-resistant. Although salvaged materials, each of the plurality of salvaged guardrail materials 30 maintains nearly all of the same weather-resistant properties, durability and extreme strength found in the same materials when new.

Referring now to FIG. 2*b*, two of the W6×9 guardrail posts 36*b* and 36*c* are selected for retasking. FIG. 2*c* illustrates cutting guardrail post 36*c* into three approximately equal lengths, 36*c*1, 36*c*2 and 36*c*3, each approximately two feet in length. Guardrail post 36*b* is then welded to portion 36*c*1 as illustrated in FIG. 2*d*. In this way, a first resized guardrail post 40 is provided after weld 38 is complete. To maintain some of the weather-resistant properties of the original guardrail materials, a weather-resistant coating is applied as illustrated in FIG. 2*e*. A weather-resistant coating, such as a zinc-based paint 44, is applied in a common spray method using paint sprayer 42 so as to cover weld 38 and the immediately surrounding area. In this way a completed first resized guardrail post 40 is provided.

Figure 2F:
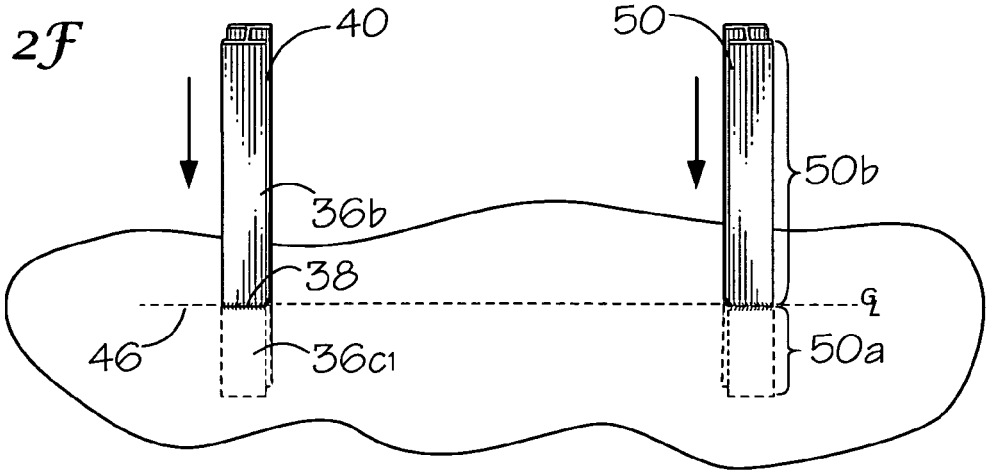
FIG. 2*f* illustrates inserting approximately two feet of the length of a first and second resized guardrail post into a ground surface so as to provide a first and second vertical support beam.

FIG. 2*f* illustrates inserting the first resized post 40 into a ground surface 46 approximately two feet so that the portion designated 36*c*1 is under the ground surface and the six-foot portion 36*b* remains above ground. As illustrated, the first resized post 40 protrudes in a substantially vertical manner to provide a first vertical support beam. A second resized W6×9 post 50 is provided in the same manner as illustrated in FIGS. 2*a* through 2*e* and inserted into ground surface 46 approximately two feet so that portion 50*a* is approximately equal to 36*c*1 and 50*b* is approximately equal to 36*b*. In this way, resized post 50 operates in the same manner as resized post 40 to provide a second vertical support beam.

Figure 2G:
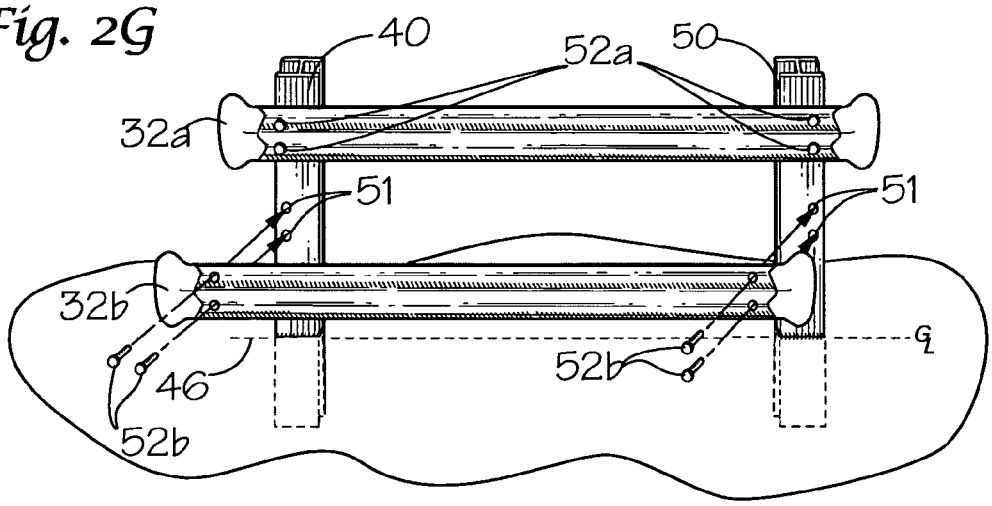
FIG. 2*g* illustrates mounting two W-beam guardrails to two resized posts.

FIG. 2*g* illustrates mounting two W-beam guardrails 32*a* and 32*b* to resized guardrail posts 40 and 50. Bolts 52*b* are inserted into holes drilled on the face of W-beam guardrail 32*b* through matching holes 51 on each resized guardrail post as illustrated. Once attached, each of the W-beam guardrails 32*a* and 32*b* are permanently mounted to the face of the first and second resized guardrail posts 40 and 50 using tightened bolts 52*a*.

Figure 2H:
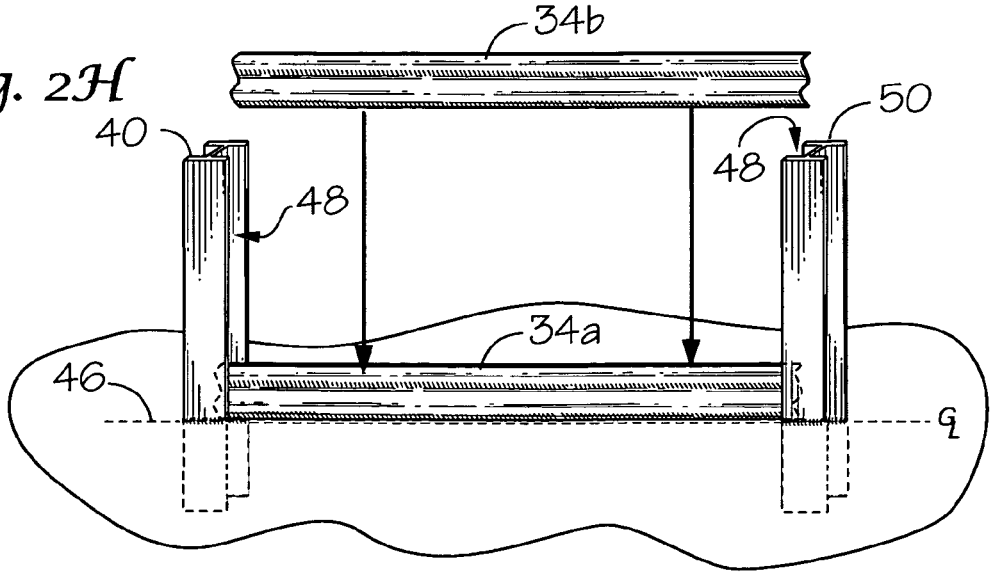
FIG. 2*h* illustrates mounting W-beam guardrails into the recess defined within two opposing W6×9 resized posts.

FIG. 2*h* illustrates an alternative embodiment wherein W-beam guardrails 34*a* and 34*b* are vertically inserted into the recesses 48 in each of the opposing resized guardrail posts 40 and 50. In this manner, W-beam guardrails 34*a* and 34*b* can be stacked to provide a more complete barrier for use in applications such as the agricultural wind break illustrated in FIG. 1*b*. The recesses 48 defined along each side of the resized W6×9 posts 40 and 50 provide a suitable mounting location for each of a plurality of W-beam guardrails stacked in the manner shown in FIG. 2*h*.

Retasking salvaged materials as described above and below allows state DOTs to sell these discarded materials to aftermarket fencing and barrier companies, rather than paying for landfill disposal or recycling. In this way, state DOTs receive a net return on the initial investment rather than a net loss once the new guardrail materials must be discarded. That net return can be put to use by DOTs to engage in greater numbers of highway improvement projects, thereby improving the overall transportation system in the United States.

Figures 3A, 3B, 3C:
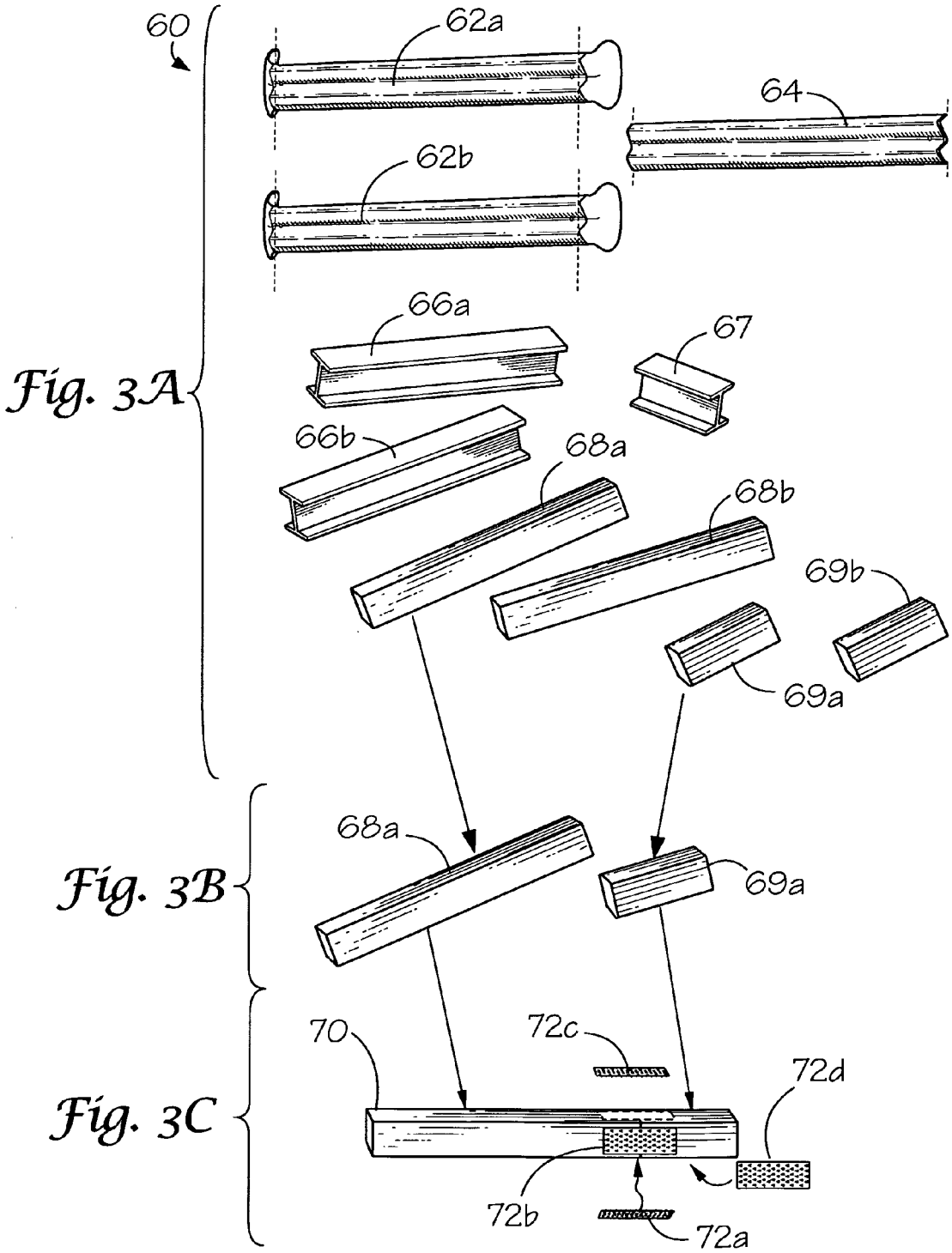
FIG. 3*a* illustrates a plurality of salvaged guardrail materials including W-beam guardrails, W6×9 guardrail posts, W6×9 blockouts, timber guardrail posts and timber blockouts.
FIG. 3*b* illustrates selecting a first and second length of guardrail post material.
FIG. 3*c* illustrates joining the distal ends of a first and second selected guardrail post material using four large wood staples to provide a resized guardrail post made of timber.

Referring now to FIG. 3*a*, a more comprehensive plurality of salvaged guardrail materials 60 is illustrated including W-beam guardrails 62*a*, 62*b* and 64; W6×9 guardrail posts 66*a* and 66*b*, each approximately six feet in length; a W6×9 guardrail blockout 67, approximately 14 inches to 22 inches in length; timber guardrail posts 68*a* and 68*b*, each approximately six feet in length; and timber blockouts 69*a* and 69*b*, each approximately 14 inches to 22 inches in length.

FIG. 3*b* illustrates selecting two guardrail post materials from plurality 60. In this example, two timber guardrail post materials are selected consisting of timber guardrail post 68*a* and timber guardrail blockout 69*a*. Timber guardrail post 68*a* is selected along with the shorter timber guardrail blockout 69*a* so that the combination of the two combines to a total length greater than six feet.

FIG. 3*c* illustrates joining the distal end of the first guardrail post material 68*a* with the distal end of the second guardrail post material 69*a* using four large wood staples 72*a*, 72*b*, 72*c* and 72*d*. In this way, a first resized guardrail post 70 is provided.

The first resized guardrail post 70 is inserted into ground surface 74 to a desired depth necessary to provide a first vertical support beam. In this example, first resized guardrail post 70 is inserted to a desired depth of approximately twenty-five percent of the total length of resized guardrail post 70, whereby the entirety of portion 69*a* is underground.

Figure 3D:
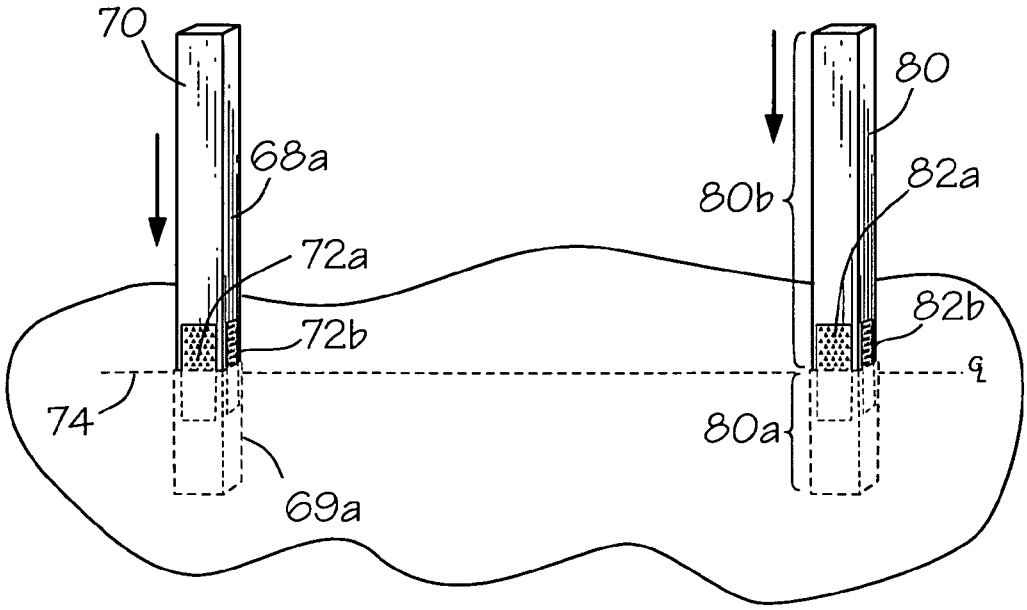
FIG. 3*d* illustrates inserting the distal ends of a first and second resized guardrail post into a ground surface so as to provide a first and second vertical support beam.

FIG. 3*d* also illustrates a second resized guardrail post 80, which is provided in the same manner as the first resized guardrail post 70 illustrated in FIGS. 3*a* through 3*c*. Second resized guardrail post 80 is also inserted into ground surface 84 a desired depth at 80*a* so that a desired height 80*b* remains above ground surface 74 in a substantially vertical manner so as to provide a second vertical support beam.

Figure 3E:
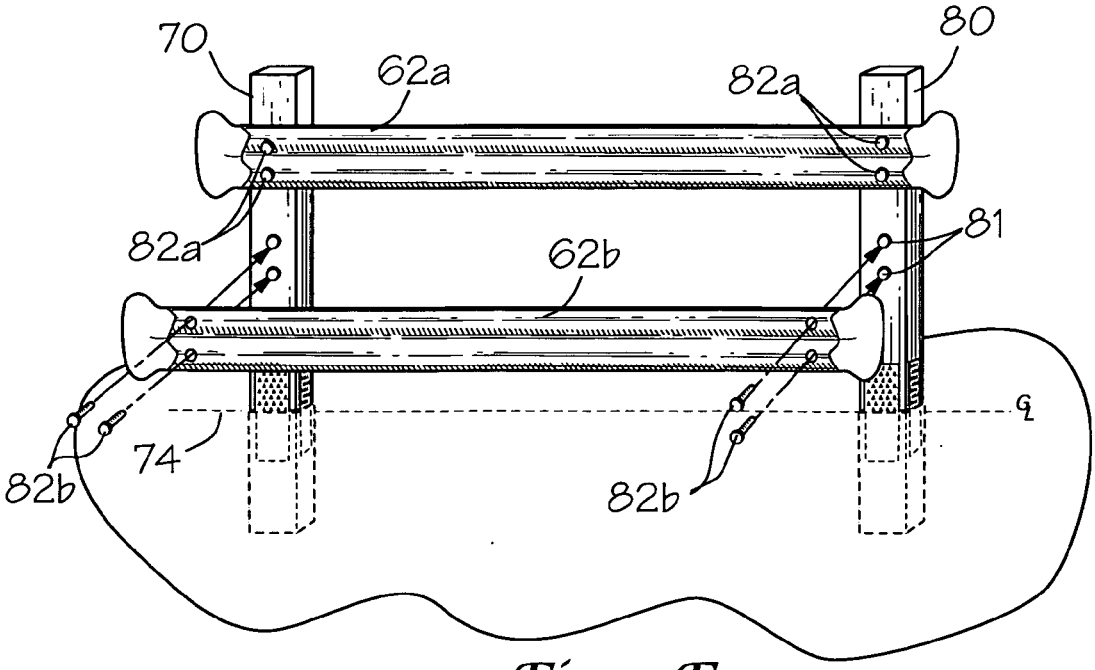
FIG. 3*e* illustrates mounting a first and second W-beam guardrail to a first and second resized guardrail post.

Once at least two vertical support beams are provided, W-beam guardrails are mounted on each of the resized posts 70 and 80, as illustrated in FIG. 3*e*. W-beam guardrails 62*a* and 62*b* are mounted using fasteners 82*a* and 82*b* as illustrated. Fasteners 82*b* are inserted through holes drilled in the surface of W-beam guardrail 62*b* and through matching holes 81 drilled through each resized guardrail post 70 and 80. Once permanently fastened in the manner shown for W-beam guardrail 62*a*, fasteners 82*a* securely hold W-beam guardrail 62*a* to the surface of resized guardrail posts 70 and 80.

Although not illustrated, various additional embodiments are possible using the invention similar to what is described and illustrated herein. For example, the barrier system 10 illustrated in FIG. 1*a* is also suitable for use in many other non-highway applications such as agricultural bale feeders, bunk feeders, fencing, cribbing and snow drift catches. The invention is further adaptable for use in industrial safety applications to provide barriers for protection of critical materials, heavy machinery, traffic flow and personnel protection. The invention is also adaptable for providing barriers for use in parking lot traffic control, private residential or campus safety, security fencing and race track barriers. And finally, the invention as described herein is also adaptable for a variety of homeland security application such as perimeter fencing, airport barriers and fencing, military base barriers and fencing, protection of government installations and building and protection of high security or sensitive locations.

As described above, most non-highway applications require different lengths of guardrail and guardrail posts for differing mounting heights so that standard highway-configured guardrails and posts are not suitable for aftermarket retasking. The present invention addresses these deficiencies by providing a system and method of using formerly DOT-approved salvaged guardrail materials in a variety of alternative applications not requiring DOT approval. In this way, state DOTs can recoup nearly twice as much in selling the used materials for reuse rather than recycling. In addition, farmers and other alternative users are able to afford and use these very high quality materials once reconfigured for different lengths and heights. And finally, retasking avoids potential environmental damage from placing this galvanized material in landfills where zinc, a mild toxin, leeches into the surrounding soil.

While preferred embodiments of the invention have been shown and described, modifications and variations may be made thereto by those skilled in the art without departing from the spirit and scope of the present invention. It should be understood, therefore, that other aspects of the invention are possible and that various aspects of the embodiments offered may be interchanged in whole or in part. Furthermore, those of ordinary skill in the art will appreciate that the foregoing description is by way of example only and is not intended to limit the invention as further described in the following claims.

The invention claimed is:

1. A method of adapting salvaged highway guardrail materials to provide multifunctional, weather resistant, reinforced barrier systems in an environmentally responsible manner comprising the steps of:

providing a plurality of salvaged highway guardrail materials comprising W6×9 guardrail posts having a length of approximately six feet and W-beam guardrails of various lengths, wherein said plurality of salvaged highway guardrail materials was originally manufactured using AASHTO M 270/M 270M grade steel;

selecting a first and second of said W6×9 guardrail posts from said plurality of salvaged highway guardrail materials;

cutting said second W6×9 guardrail post to provide a shortened W6×9 guardrail post of approximately two feet;

welding a distal end of said first W6×9 guardrail post to a distal end of said shortened W6×9 guardrail post to permanently join said first W6×9 guardrail post and said shortened W6×9 guardrail post, thereby providing a first resized W6×9 post having a continuous length of approximately eight feet;

applying a weather-resistant coating to the welded junction of said first resized W6×9 post to prevent degradation from weather and ground exposure;

inserting a distal end of said first resized W6×9 post into a ground surface approximately two feet for stabilization in a vertical orientation, whereby approximately six feet of said first resized W6×9 post protrudes from said ground surface in a vertical arrangement to provide a first vertical support beam;

providing a second resized W6×9 post in the manner defined for providing said first resized W6×9 post;

applying a weather-resistant coating to the welded junction of said second resized W6×9 post to prevent degradation from weather and ground exposure;

inserting a distal end of said second resized W6×9 post into a ground surface approximately two feet for stabilization in a vertical orientation and spaced at least one foot horizontally from said first resized W6×9 post, whereby approximately six feet of said second resized W6×9 post protrudes from said ground surface in a vertical arrangement to provide a second vertical support beam;

mounting a first end of at least one W-beam guardrail to said first resized W6×9 post and a second end to said second resized W6×9 post in a fixed and generally horizontal arrangement to define a barrier to passage between said first resized W6×9 post and said second resized W6×9 post.

2. The method of claim 1 further comprising the step of mounting said first end of at least one W-beam guardrail within a recess defined along one side of said first resized W6×9 post and said second end of at least one W-beam guardrail within a recess defined along an opposing side of said second resized W6×9 post.

3. A method of retasking salvaged guardrail materials into multifunctional, weather resistant, reinforced barrier systems comprising the steps of providing a plurality of salvaged highway guardrail materials comprising W6×9 guardrail posts having a length of approximately six feet, W6×9 guardrail blockouts having a length of approximately 14 inches to 22 inches, and W-beam guardrails of various lengths, wherein said plurality of salvaged highway guardrail materials was originally manufactured according to AASHTO standards;

selecting a first and second length of guardrail post material from said plurality of salvaged highway guardrail materials;

joining a distal end of said first length of guardrail post material to a distal end of said second length of guardrail post material to provide a first resized post;

inserting a distal end of said first resized post into a ground surface for stabilization in a vertical arrangement to provide a first vertical support beam;

providing a second resized post in the manner defined for providing said first resized post;

inserting a distal end of said second resized post into a ground surface for stabilization in a vertical arrangement to provide a second vertical support beam;

mounting a first end of at least one W-beam guardrail to said first resized post and a second end to said second resized post to define a barrier to passage between said first resized post and said second resized post.

4. The method of claim 3 further comprising the step of mounting said first end of at least one W-beam guardrail within a recess defined along one side of said first resized W6×9 post and said second end of at least one W-beam guardrail within a recess defined along an opposing side of said second resized W6×9 post.

5. The method of claim 3 further comprising the steps of applying a weather-resistant coating to the junction on said first resized post and applying a weather-resistant coating to the junction on said second resized post.

6. The method of claim 3 further comprising the step of providing said plurality of salvaged highway guardrail materials further comprising timber guardrail posts and timber guardrail blockouts, wherein each of said timber guardrail posts and each of said timber guardrail blockouts are constructed of timber having a stress rating of at least 1160 psi.

7. The method of claim 6 further comprising the step of joining a distal end of said first length of guardrail post material to a distal end of said second length of guardrail post material with wood staples.

8. The method of claim 3 further comprising the step of selecting said first and second lengths of guardrail post material from said plurality of salvaged highway guardrail materials, wherein each of said first and second lengths of guardrail post material was originally weather-coated according one of AASHTO M 111 and AASHTO M 133 standards.

9. The method of claim 3 further comprising the step of selecting said first and second lengths of guardrail post material from said plurality of salvaged highway guardrail materials, wherein each of said first and second lengths of guardrail post material was originally weather-coated as one of Type II galvanized and Type IV corrosion-resistant.

* * * * *